United States Patent [19]

Krob et al.

[11] Patent Number: 4,496,167

[45] Date of Patent: Jan. 29, 1985

[54] HEEL HOLDER COMBINED WITH A SKI BRAKE

[75] Inventors: Erwin Krob, Vienna; Friedrich Leichtfried, Traiskirchen; Helmut Bauer, Vienna, all of Austria

[73] Assignee: TMC Corporation, Baar, Switzerland

[21] Appl. No.: 350,659

[22] Filed: Feb. 22, 1982

[30] Foreign Application Priority Data

Feb. 20, 1981 [AT] Austria ..... 798/81
Mar. 13, 1981 [AT] Austria ..... 1187/81

[51] Int. Cl.[3] ..... A63C 7/10
[52] U.S. Cl. ..... 280/605; 280/632
[58] Field of Search ..... 280/605, 604, 631, 632

[56] References Cited

U.S. PATENT DOCUMENTS 4,168,083 9/1979 Storandt ..... 280/605
4,231,584 11/1980 Kikuchi ..... 280/605

FOREIGN PATENT DOCUMENTS 2532736 2/1977 Fed. Rep. of Germany .
2535552 2/1977 Fed. Rep. of Germany .
2613037 9/1977 Fed. Rep. of Germany ..... 280/605
2635621 2/1978 Fed. Rep. of Germany .
2707625 8/1978 Fed. Rep. of Germany ..... 280/605
2746340 4/1979 Fed. Rep. of Germany ..... 280/605

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A heel holder includes a ski brake, a bearing block which is arranged on a base plate, and a housing which is supported swingably on the bearing block, wherein the housing carries a sole hold-down member which is under the influence of a spring, and is held in the skiing position by a locking lever or a pawl, and wherein braking mandrels of the ski brake, with respect to their swivelling movement to the braking position, are controlled by the housing. In order to permit an opening of the heel holder and a swivelling of the ski brake into the braking position in a simple manner when only the front jaw of the ski binding has released, the ski brake is provided with a stepping plate and is operatively connected through a coupling or operating member to the locking lever or the pawl.

29 Claims, 14 Drawing Figures

HEEL HOLDER COMBINED WITH A SKI BRAKE

FIELD OF THE INVENTION

This invention relates to a heel holder and, more particularly, to a heel holder which is combined with a ski brake and includes a bearing block arranged on a base plate which is secured on a ski and a housing which is supported for pivotal movement about a transverse axis in the bearing block, carries the sole downholding means, is under the influence of a torsion spring or the like, and is held in the skiing position by means of at least one spring-loaded locking lever or at least one spring-loaded pawl, the braking mandrels of the ski brake being pivotal about a transverse axle in the base plate and being controlled with respect to their swivelling movement to the braking position by the housing.

BACKGROUND OF THE INVENTION

In a conventional heel holder of this type, for example that disclosed in German Offenlegungsschrift No. 25 35 552, directing plates are attached to the sidewalls of the housing which is pivotal and movable longitudinally of the ski in the closed or skiing position and extend approximately parallel to the upper side of the ski, with which are associated guide plates which are secured to the upper ends of the braking mandrels. The guide plates rest on the underside of the directing plates in the skiing position, which causes the two braking mandrels to be in the retracted position. However, when the housing is swung into the released position, then the guide plates slide along the underside of the directing plates, whereby the braking mandrels are simultaneously swung into the braking position. If, however, only the front jaw is released and the ski boot leaves the upper side of the ski, then a spring moves the housing toward the tip of the ski. This causes the two directing plates to disengage from the guide plates, and the braking mandrels swing under the influence of the springs into the braking position.

This arrangement has the disadvantage that the swinging of the two braking mandrels back into their retracted position presents difficulties since, when the housing is tilted up, the directing plates extend approximately normal to the guide surfaces. When the heel holder is not released, it is possible for the guide plates to sometimes rest on the upper side of the directing plates, which prevents a return of the braking mandrels to their retracted position.

A similar embodiment is disclosed in German Offenlegungsschrift No. 25 32 736. A guide rail in this embodiment is attached to the housing of the heel holder on the inside or outside, into which guide rail extends the end of the ski brake. The ski brake is supported swingably in the base plate. If the ski boot is placed onto the ski, the ski brake is swung automatically from the braking position to the retracted position, and of course the housing returns from the released position to the skiing position. The guide rail can thereby be constructed in such a manner that the braking mandrels of the ski brake not only carry out a swivelling movement, but at the same time a tongslike movement so that they rest over the upper side of the ski.

This heel holder had the disadvantage that, during a release of the front jaw, the ski brake could not swing into the braking position, because it was prevented from doing so by the heel holder.

A goal of the invention is to overcome the disadvantages of the conventional embodiments and to provide a heel holder of the abovementioned type in which, for the case in which the front jaw releases by itself, the ski brake swings reliably into the braking position and the heel holder opens at the same time. In this manner, the possibility for a stepping of the ski boot into the ski binding will also come to exist when the release occurs only by means of the front jaw.

SUMMARY OF THE INVENTION

This goal is achieved inventively by operatively connecting the ski brake which is provided with a stepping plate to the locking lever or to the pawl through a coupling or operating member.

In the first embodiment of the invention, the coupling member is formed by a linking rod which is hinged on one side to the ski brake and on the other side to the end of the locking lever. It has been proven advantageous if the linking rod has a slotlike hole at its end which faces the locking lever, in which slotlike hole is received a pin which is secured on the end of the locking lever. The linking rod is hinged advantageously to the half of the stepping plate which is adjacent the swivel axis of the ski brake.

In a different inventive embodiment, the operating member is a lever which is pivotally supported, preferably on the housing, about a transverse axis which is parallel to the upper side of the ski. It has thereby proven advantageous if the lever is designed with two arms, whereby a control cam on the locking lever cooperates with the lever arm which projects toward the housing. In this manner, the control cam is used not only for guiding the locking lever along the locking member during a voluntary release, for example along a pin, but at the same time for providing the lever arm a contact surface. This means a simplification in the structural design of the heel holder.

In order to permit satisfactory relative movement of the ski brake and lever, the invention provides furthermore that the arm of the lever which is remote from the housing has a slotted hole, in which is guidedly received a pin secured on the ski brake. This pin is arranged advantageously on the half of the stepping plate which is adjacent the swivel axis of the ski brake. However, it would also be conceivable to secure the pin on the lever and to guide it in a groove in the stepping plate of the ski brake.

In a further embodiment according to the invention, the operating member is constructed as a rod, which is hinged at one end to the ski brake and has its other end freely resting on the pawl, for example in the extension of the axis of the spring which biases the pawl. It has proven particularly advantageous if the rod is supported in a bearing eye provided on the end of the stepping plate of the ski brake which is adjacent the swivel axis. To assure a proper engagement of the rod end with the pawl, the invention provides furthermore that the end of the rod which rests on the pawl is guided in a guideway in the base plate and/or the bearing block.

However, in the case of heel holders with pawls, it is not absolutely necessary to bring about the connection between the stepping plate and the pawl by a rod. Rather, according to a different modification of the invention, the operating member can also be constructed as a draw element which has one end hinged to the stepping plate of the ski binding and the other end engaging the spring-loaded pawl. If in this modification the pawl is constructed as a two-arm lever, there are two possible arrangements: either the lever can be biased by a pressure spring on the arm which carries the pawl tooth, the lever carrying on the opposite arm the point of engagement of the draw element, or the lever arm which is remote from the pawl tooth can carry the points of engagement of both the draw element and the spring, which spring is a contraction spring.

Finally, a different inventive embodiment is distinguished by the pawl being a locking part which is supported in the housing, the rear side of which locking part is engaged by a locking part biased by a locking spring and guided in a spring fork, and by the operating member which is moved by the stepping plate of the ski brake being operatively connected, through the spring fork, to the locking part. Since in this embodiment, the control of the spring-loaded pawl is achieved without additional levers with slotlike holes in which pins slide, no further elements are needed here, aside from the operating member, in order to bring about the desired result.

In this embodiment, it has proven advantageous in a further development of the invention when the operating member is formed by two control rods which extend longitudinally of the ski and, if desired, are hinged to the stepping plate at a location spaced from its swivel axis. The free ends of the two control rods can thereby carry preferably upwardly directed control cam which are cooperable with control cams which are arranged at the free ends of the spring fork and preferably point downwardly. This represents a particularly simple and therefore also very economical technical solution.

In order to reliably support the two control rods, the invention provides that the free ends of the control rods are slidably guided on the upper side of the base plate. For the lateral guiding of the control rods there are provided in the housing of the heel holder, according to a further characteristic of the invention, downwardly open slots and, in the front part of the bearing block, vertically arranged slotlike holes. In this manner, opening of the heel holder is assured, even when for some reason a strong lateral force acts onto the two control rods or on one of the two.

Should it create difficulties for structural reasons to provide the control cams on the rods and/or the spring fork with the height which is needed to assure a proper opening of the heel holder, then according to a different characteristic of the invention there exists the possibility to mount two projections, for example, wedge-shaped projections, on the base plate in the area below the free ends of the spring fork, which projections serve to lift the free ends of the control rods. In this case, there even exists the possibility to omit the control cams at the free ends of the spring fork.

To permit easy movement of the two control rods, according to a different development of the invention the base plate is provided in the area of the path of movement of the free ends of the two control members with a coating of a friction reducing material, for example, tetrafluoroethylene. Furthermore, the two control rods and/or the spring fork can, in the area of the control cams thereon, be hardened to reduce the wear in the areas which slide on one another, without the strength of the material which is needed for the remaining areas of the mentioned elements being reduced.

Finally, there exists according to the invention also the possibility of guiding the two control rods over their entire length on the base plate and moving them by means of cams or eccentrics which are secured on the swivel axle of the stepping plate.

BRIEF DESCRIPTION OF THE DRAWINGS

The drawings illustrate exemplary embodiments of the subject matter of the invention. In the drawings.

DETAILED DESCRIPTION

Figure 1:
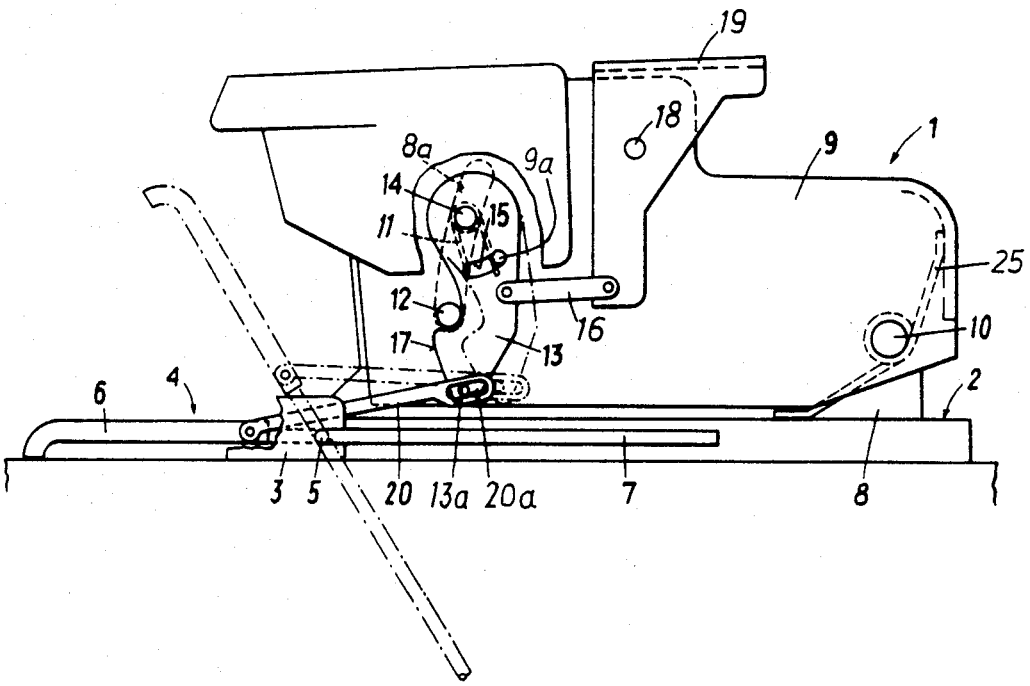
FIG. 1 is a fragmentary side view of a heel holder which is connected to the ski brake by linking rods.

A heel holder 1 is illustrated in FIG. 1 and has a base plate 2, the front area 3 of which supports a ski brake 4 for pivotal movement about an axle 5. The ski brake 4 has a stepping plate 6 which, in the braking position, projects upwardly and has two braking mandrels 7 which, in the braking position, are directed downwardly. The ski brake 4 is urged toward the braking position by a conventional spring (not illustrated).

The heel holder 1 has a bearing block 8 which is secured on the base plate 2 and over which a housing 9 is disposed. The housing 9 is supported pivotally on an axle 10 in the bearing block 8 and is biased pivotally by a spring 25. An arc-shaped slot **8*a* is provided in the bearing block 8, in which slot 8*a* is slidably guided a pin member 12**.

The pin 12 is part of a conventional release mechanism and is engaged in a conventional manner by a not illustrated control cam arranged on a not illustrated spring-loaded lever. The spring can, in a conventional manner, be adjusted for different release forces. The lever is supported swingably on the bearing block 8, and the spring is arranged in a recess in the bearing block 8. This conventional mechanism, of which only the pin 12 is illustrated, is not discussed here in any greater detail, because this mechanism on the one hand is actually known and on the other hand is not directly a part of the present invention.

Each leg of a U-shaped release lever 19 is supported for pivotal movement about an axle 18 and two one-arm levers 13 are supported for pivotal movement about an axle 14, one on each side of the housing 9. Each lever 13 is connected by a linking plate 16 to the release lever 19 and is pivotally biased by a torsion spring 11. The range of swinging movement of the lever 13 is limited by an arc-shaped slot 15 which is arranged in the lever and is engaged by a pin 9*a* secured to the housing 9. The lever 13 has a control cam 17 on its front side with a notch which is cooperable with the pin 12.

The lower end of the lever 13 carries a pin 13*a* which is slidingly received in a slotlike hole 20*a* at the end of a linking rod 20. The other end of the linking rod 20 is hinged to the end of the stepping plate 6 which is adjacent the axle 5.

During an automatic release of the heel holder 1, the lever 13 remains in the position illustrated in FIG. 1, in which it grips the pin 12. The housing 9 together with the lever 13 and the pin 12 pivot upwardly about the axis 10 in a clockwise direction against the force of the locking spring (not illustrated), thereby releasing the ski boot. This is facilitated by the fact that the pin 12 is movably guided in the slot 8*a*. Since the pin 13*a* at the lower end of the lever 13 is guided in the slotlike hole 20*a* of the linking rod 20, the linking rod in no way hinders the initial swivelling movement of the housing 9. Only after the housing 9 has swivelled through a predetermined angle is the linking rod 20 effective to cause a forced swivelling of the ski brake 4, which in any case is biased by its erecting spring (not illustrated).

If during an automatic release, the heel holder 1 does not open, but instead the not illustrated front jaw opens and allows the ski boot to leave the ski, then the ski brake 4 will be swivelled by its erecting spring from the retracted position parallel to the upper side of the ski into its braking position inclined to the upper side of the ski, in which position the two braking mandrels 7 project downwardly. The pin 13*a* thereby comes into engagement with the left end of the slotted hole 20*a* and pivots the lever 13 in a counterclockwise direction. With this, the pin 12 is released by the lever 13 and the housing 9 pivots about the axle 10 under the influence of the spring 25. In this manner, a release of the front jaw not only results in a swinging of the ski brake 4 into the braking position, but at the same time results in an opening of the heel holder 1 so that same is ready for a new stepping in of the ski boot.

If, on the other hand, a voluntary release is desired, then it is sufficient to manually swing the two levers 13 counterclockwise by means of the release lever 19 and linking plates 16, so that their control cams 17 become disengaged from the pin 12.

Figure 2:
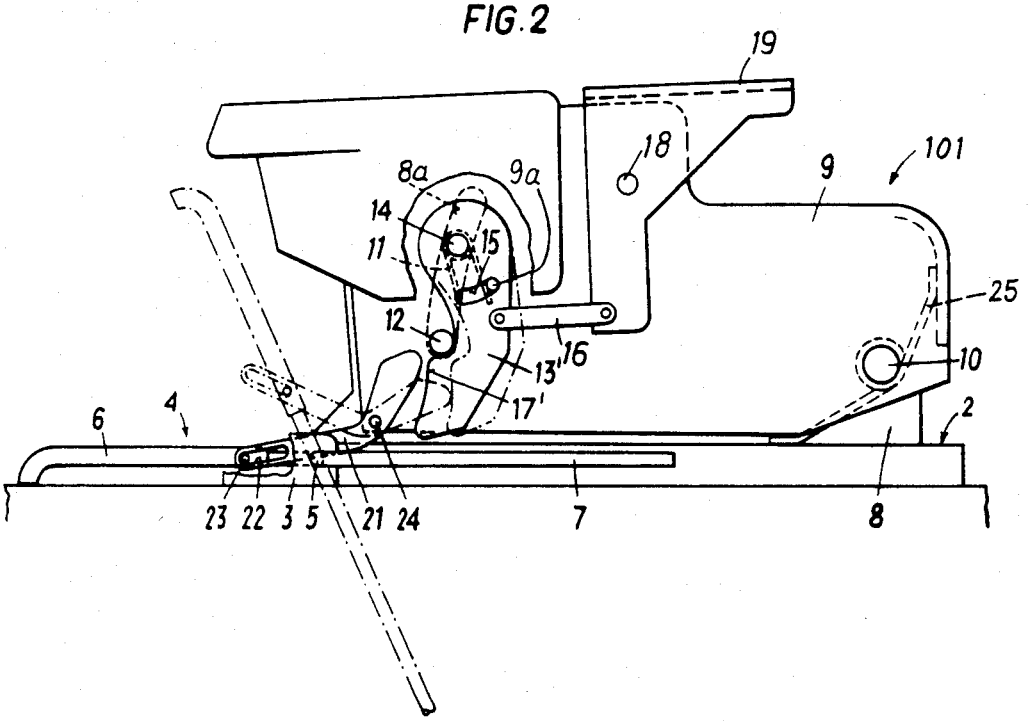
FIG. 2 is a fragmentary side view of an alternative embodiment in which the heel holder and ski brake are connected by two levers.

The exemplary embodiment according to FIG. 2 is similar in many respects to the first exemplary embodiment. Here, the heel holder 101 is also arranged on a base plate 2 and the ski brake 4 is supported for pivotal movement about an axis 5 at the front end 3 of the base plate 2. The ski brake 4 has a stepping plate 6 which projects upwardly in the braking position and two braking mandrels 7 which are directed downwardly in the braking position. The ski brake 4 is urged toward the braking position by a conventional erecting spring (not illustrated).

The design of the heel holder 101 in FIG. 2 corresponds substantially with the heel holder 1 in FIG. 1. However, the levers 13' do not carry pins. Rather, the control cam 17' on each for the pin 12 serves simultaneously as a bearing surface for one arm of a respective two-arm linking or operating lever 21 which is supported for pivotal movement about an axle 24 on the housing 9, the other arm of which has a slotlike hole 22 slidingly engaged by a pin 23 secured on the stepping plate 6 of the ski brake 4.

In the skiing position, the arm of the operating lever 21 nearest the control cam 17' is spaced slightly from the control cam 17'. If an automatic release of the front jaw occurs and the ski boot leaves the upper side of the ski, then the ski brake 4 pivots into its braking position under the influence of its erecting spring, in which position the two braking mandrels 7 project downwardly. Since the stepping plate 6 is coupled to the operating lever 21 by the pin 23 and the slotlike hole 22, pivoting of the lever 21 occurs simultaneously with pivoting of the brake 4, causing the lever 21 to come into contact with the control cam 17' and swing the lever 13' counterclockwise. The pin 12 is thus released from the control cam 17' and the housing 9 swings into its released position under the urging of the spring 25.

If, on the other hand, the automatic release is caused by the heel holder 101, then the housing 9, during its upward swing, takes along the axle 24 of the lever 21, thereby swinging the ski brake 4 into its braking position.

A voluntary release here too is effected by manually swinging up the release lever 19, which is coupled to the lever 13' by linking plate 16.

Figure 3:
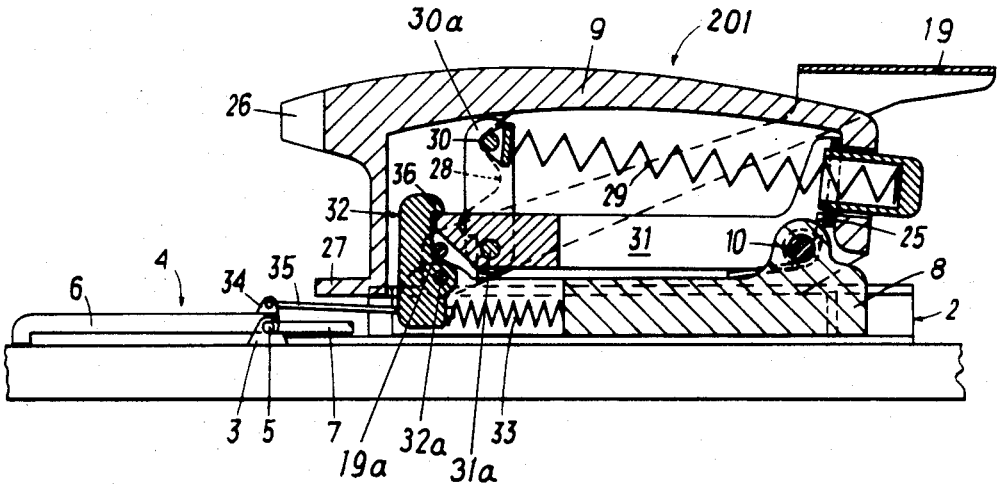
FIGS. 3 and 4 are longitudinal sectional side views of two operations positions of a further embodiment in which two rods effect the connection between the heel holder and ski brake and are supported pivotally only on the ski brake.
Figure 4:
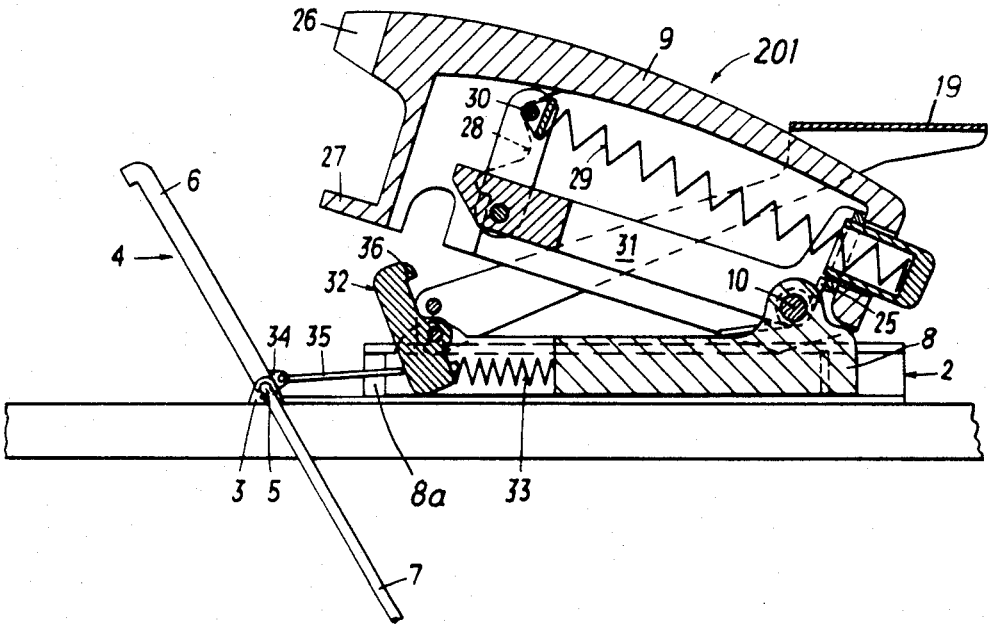

FIGS. 3 and 4 illustrate the invention incorporated into a heel holder of the type described in German Offenlegungsschrift No. 28 41 869. FIG. 3 illustrates the skiing position and FIG. 4 the released position of the heel holder. This heel holder 201 has a base plate 2 which must be secured on the ski and on which a bearing block 8 is arranged. The bearing block 8 carries a swivel axle 10 for a housing 9 and the housing 9 is biased by a torsion spring 25 which urges it in a clockwise direction. Reference numeral 19 identifies a release lever which, as is actually known, is supported on the axle 32*a* of two locking levers or pawls 32 and acts onto the pawls 32 through shoulders 19*a* thereon. The housing 9 carries on its front side a down-holding means 26 and a stepping spur 27 for a ski shoe sole. The housing 9 is equipped in its inner area with a control cam 28 which is engaged by a pin 30 biased by a release spring 29. The pin 30 is supported swingably by two laterally spaced plates 30*a* and an axle 31*a* on a spring fork member or support element 31 which in turn is pivotally supported on the swivel axle 10 of the housing. The two forward ends of the spring fork 31 are constructed as noses which cooperate with two respective pawls 32 which are supported swingably on the bearing block 8 by axle 32*a*. The pawls 32 are each biased pivotally by a pressure spring 33.

During a voluntary release, the two pawls 32 in this embodiment are pivoted counterclockwise by manual operation of the release lever 19 and release the noses of the spring fork 31 which, under the influence of the torsion spring 25, swings upwardly together with the housing 9. During an automatic release, on the other hand, the pin 30 slides along the control cam 28 and the housing 9 swings into the release position, but without spring fork 31, which is held on the bearing block 8 by the pawls 32.

In order to facilitate the provision of the invention in this heel holder, the base plate 2 is extended slightly forwardly and a ski brake 4 is supported for pivotal movement about an axle 5 in this front area 3. The ski brake 4 includes, as in the preceding exemplary embodiments, a stepping plate 6 and two braking mandrels 7. A bearing eye 34 is provided on each side of the stepping plate 6 at the end thereof adjacent the swivel axle 5, and a rod 35 is supported pivotally in each bearing eye. The other end of each rod 35 is guided with clearance through a slotlike guideway 8*a* in the bearing block 8 and engages a front surface on a pawl 32. Each pawl 32 is constructed as a two-arm lever, one arm of which carries a pawl tooth 36 and the other arm of which carries the points of engagement of the rod 35 and the pressure spring 33.

If the front jaw releases automatically, then the ski brake pivots into the braking position under the influence of its spring and, through the two rods 35, presses the pawls 32 into the position in which notches defined by the pawl teeth 36 release the noses on spring fork 31, thereby releasing the heel holder.

Figure 5:
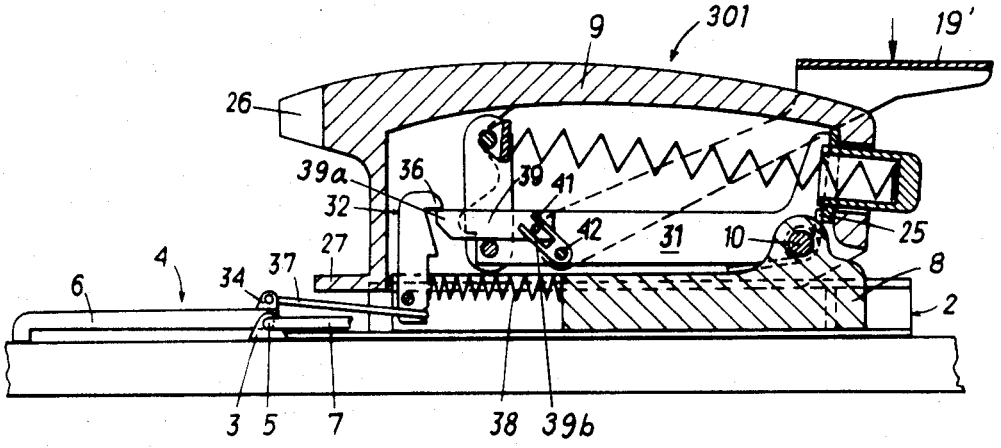
FIGS. 5 and 6 are longitudinal sectional side views of two further embodiments which each have two draw elements to effect the connection between the heel holder and ski brake.
Figure 6:
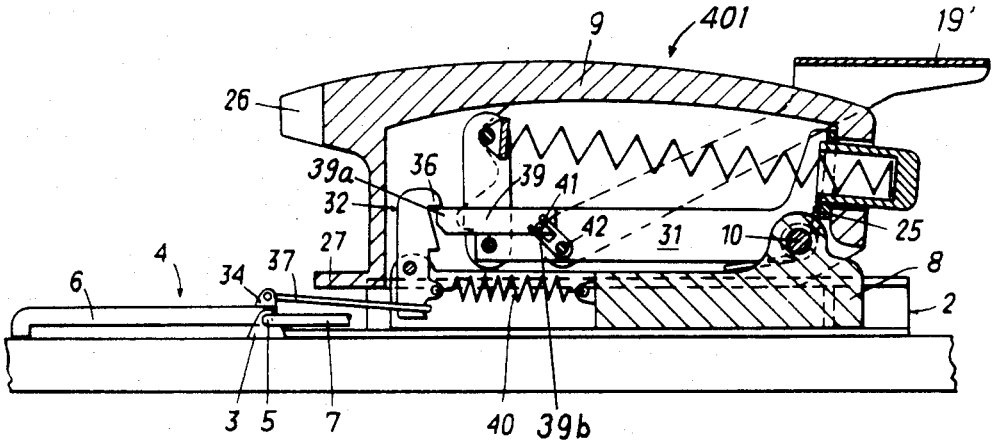

FIGS. 5 and 6 each illustrate a modification of the embodiment which is illustrated in FIGS. 3 and 4. In each of these modified embodiments, the spring fork 31 is held in the locked position by two pawls 32, which are again constructed as two-arm levers, by means of pawl teeth 36. However, the connection between each pawl 32 and the stepping plate 6 of the ski brake 4 is not effected by rods in these embodiments, but by linking or draw elements 37, each of which engages the rear side of the arm of a pawl 32 which is remote from the pawl tooth 36. If the spring for the pawl 32 is a pressure spring 38, it cooperates with the arm which carries the pawl tooth 36 (FIG. 5), but if it is a tension spring 40, it cooperates with the same lever arm as the draw element 37 (FIG. 6).

In order to provide, in the modifications according to FIGS. 5 and 6, for the possibility of a manual release, the two noses 39*a* at the forward end of the spring fork 31 are not constructed integral therewith, but are provided on slide members 39 which are movably guided on the prongs of the spring fork 31 and carry on at least one side surface a short pin 39*b* which engages a slot at the end of a crank arm 41. The crank arm 41 is secured on a shaft 42 which is rotationally supported in the spring fork 31 and can be swivelled by a release lever 19 thereon.

The operation of the embodiments of FIGS. 5 and 6 corresponds substantially with that of the exemplary embodiment illustrated in FIGS. 3 and 4, so that a detailed discussion of the operation thereof is not needed. It is necessary only to explain that manual operation of the release lever 19' causes pivotal movement of the crank arms 41, which in turn acts on the slide members 39 through the pin 39*b* and slides the slide members 39 rightwardly until the noses 39*a* thereof disengage the pawl teeth 36.

The heel holder 501 illustrated in FIGS. 7 to 10 has a base plate 2 on which is secured a bearing block 8 which is approximately U-shaped in the top view. The bearing block 8 has two side parts 8*b* which define the two legs of the U and has a front part 8*c* which extends in transverse direction and has a locking projection 8*d* thereon. A swivel axle 10 extends through the two side parts 8*b* of the bearing block 8. The swivel axle 10 carries, between the side parts 8*b*, a U-shaped support element or spring fork 31' which supports a locking spring 46 and carries, on the two sections thereof which are outside the side parts 8*b*, a housing 9 of the heel holder 501. The housing 9 carries on the side thereof which is remote from the swivel axle 10 a down-holding means 26 and stepping spur 27 for a ski shoe sole. Furthermore, a swivel axle 50 is secured in the housing 9 and, inside the housing 9, supports a locking part 51 which has approximately the shape of an inverted T and, outside the housing 9, supports a release lever 19''. This release lever 19'' serves, in a conventional manner, to move a locking member 54 biased by the locking spring 46 out of a detent in the locking part 51 and to thereby facilitate voluntary opening of the heel holder 501.

Guide slots 53 which extend longitudinally of the ski are provided in the two legs of the U-shaped spring fork 31'. The locking member 54 biased by the locking spring 46 is movably guided in the guide slots 53, whereby one end of the locking spring 46 presses the locking member 54 against the rear side of the locking part 51, which rear side is provided with the detent. The locking part 51 has on its front side a locking projection 51*a* which grips under the locking projection 8*d* on the front part 8*c* of the bearing block 8 in the skiing position. The other end of the locking spring 46 is supported on a spring plate 55, which is supported between the two legs of the U-shaped spring fork 31' and can be adjusted by means of an adjustment screw 56 thereon in the direction of the axis of the locking spring 46 in order to change the initial tension of the locking spring 46. The spring fork 31' and the housing 9 of the heel holder 1 are under the influence of at least one torsion spring 25 which urges them in a clockwise direction in FIG. 7. The two legs of the spring fork 31' carry, at their forward ends, downwardly directed control cams 58.

On the side of the heel holder 501 which faces the ski boot (not illustrated) there is provided a ski brake 4. The ski brake 4 consists of a stepping plate 6 on which two braking mandrels 7 are secured which in the braking position project downwardly and which by means of a swivel axle 5 are pivotally supported in two bearing eyes 2*a* on the base plate 2. Two linking or control rods 64 are pivotally supported on the stepping plate 6 at a location spaced from the swivel axle 5. The free ends of the control rods 64 extend in the same vertical longitudinal planes as the two legs of the spring fork 31' and are slidably guided with their undersides on the base plate 2. These ends carry upwardly directed control cams 65 which are cooperable with the control cams 58 on the ends of the legs of the spring fork 31'. The stepping plate 6 is biased by an erecting spring which urges the stepping plate 6 in a clockwise direction away from the base plate 2, which spring is conventional and not illustrated in the drawing for reasons of clarity.

This heel holder 501 operates as follows: During an automatic release of the heel holder 501, its housing 9 together with the down-holding means 26 and the stepping spur 27 in FIG. 7, swing in a clockwise direction, causing the locking projection 51*a* on the T-shaped locking part 51 to slide up over the release point of the locking projection 8*d*. After this, the housing 9, together with the spring fork 31, is pivoted further in the clockwise direction by the torsion spring 25. This has the consequence that the ski boot leaves the heel holder 1 and releases the stepping plate 6 which, under the influence of its erecting spring (not illustrated), can now swing into its braking position. The ends of the two control rods 64 which carry the cams 65 thereby move into the space between the base plate 2 and the control cams 58 of the spring fork 31'.

Figure 7:
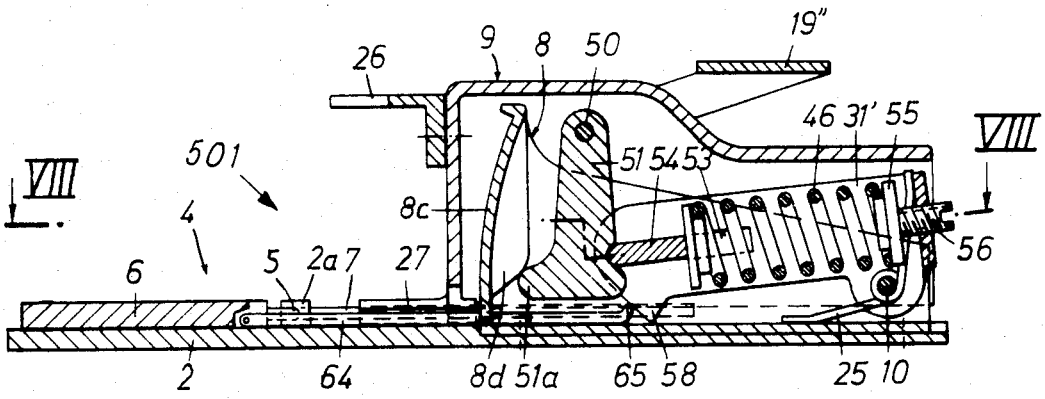
FIG. 7 is a sectional side view of a further exemplary embodiment of a heel holder taken along the line VII—VII of FIG. 8 and illustrates the heel holder in the skiing position.
Figure 8:
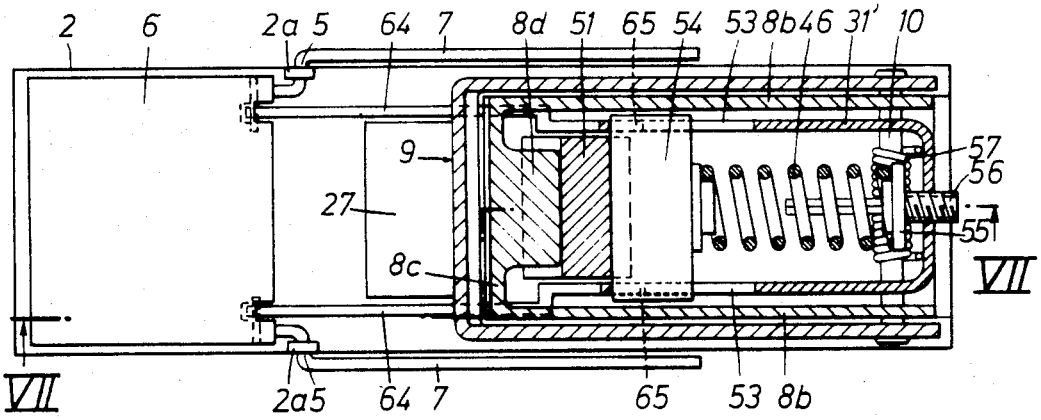
FIG. 8 is a sectional view taken along the line VIII—VIII of FIG. 7.
Figure 9:
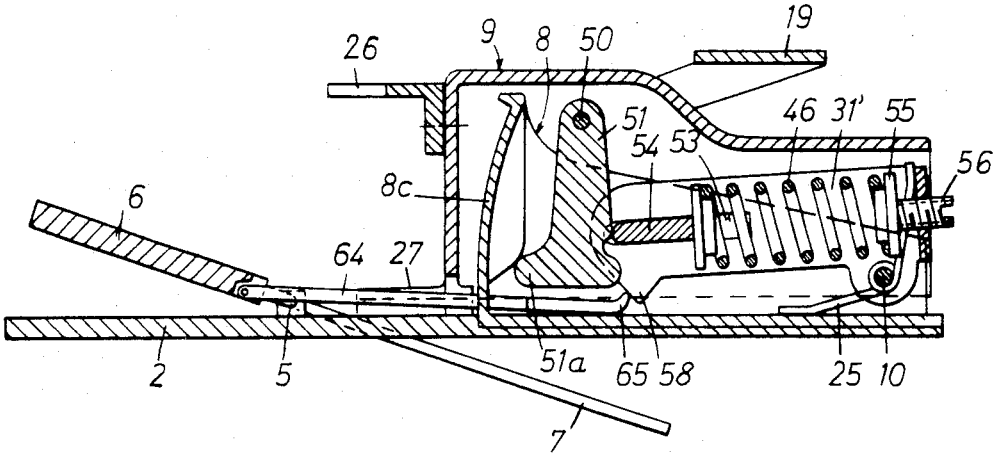
FIGS. 9 and 10 are sectional side views similar to FIG. 7 which respectively illustrate intermediate and braking positions of the ski brake of FIG. 7.
Figure 10:
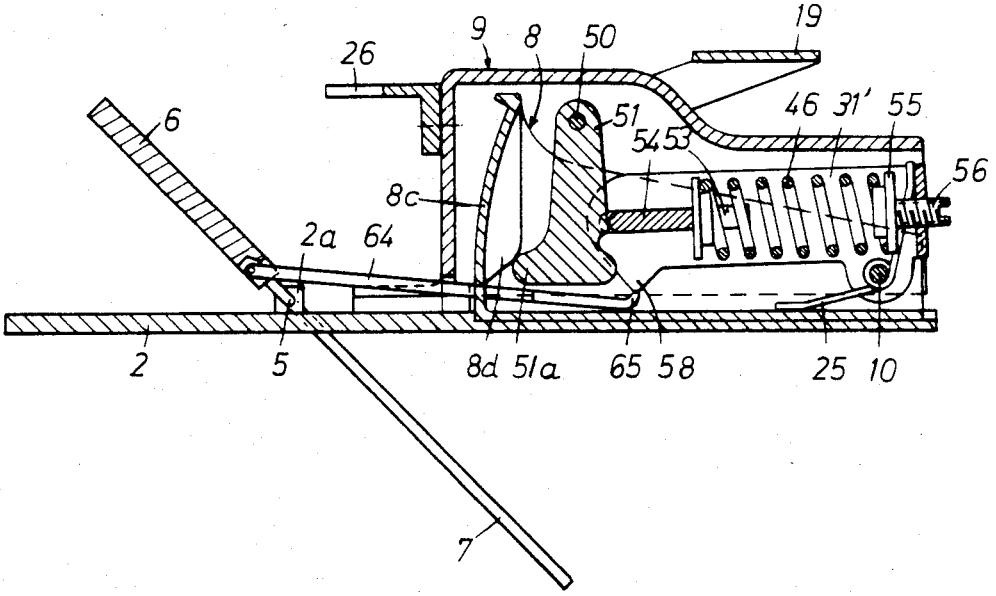

If, on the other hand, an automatic release of the ski binding occurs and the heel holder 501 does not open but rather the front jaw opens, then the ski boot leaves the ski binding and the heel holder initially remains in the skiing position (FIG. 7). By lifting the ski boot from the upper side of the ski, however, the stepping plate 6 is released and the ski brake is swung by its erecting spring (not illustrated) from the retracted position in which it is parallel to the upper side of the ski to the braking position in which it is inclined to the upper side of the ski and the two braking mandrels 7 project downwardly. At the same time, the two control rods 64 are moved rearwardly and their cams 65 engage the control cams 58 arranged on the free ends of the legs of the spring fork 31' (FIG. 9). Through this, the spring fork 31' is pivoted about the swivel axis 10 through a sufficient angle so that the locking member 54 biased by the locking spring 46 is moved, against the force of the locking spring 46, out of the detent on the rear side of the swivel part 51 and slides upwardly (FIG. 10). Through this, the swivel part 51 can be swung counterclockwise more easily, and the sole down-holding means 26 under the influence of the torsion spring 25 will move to the open position in which it is again ready for a stepping in by the user.

A voluntary release of the heel holder 501 occurs by pivoting the release lever 19, through which, in a conventional manner not discussed in detail, the locking member 54 is moved against the force of this spring 46 out of the detent on the rear side of the swivel part 51 and moves upwardly to facilitate the release.

Figure 11:
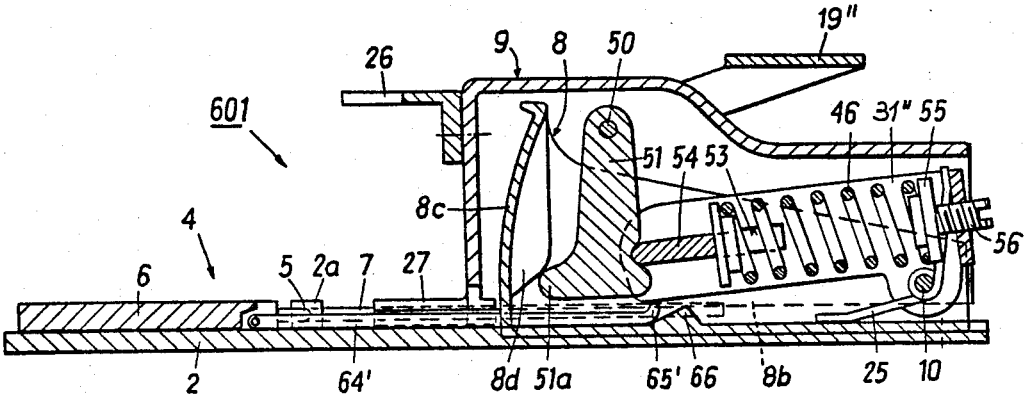
FIG. 11 is a sectional view similar to FIG. 7, showing a further embodiment of the apparatus of FIGS. 7 to 10.

The heel holder 601 illustrated in FIG. 11 is similar to the heel holder 501 shown in the FIGS. 7 to 10. We use for identical parts the same numerals. The heel holder 601 differs from the heel holder 501, however, in that the control cams 65' of the two control rods 64' do not move in the direction of the base plate 2, but move normal to this plate 2. The two control cams 65' have therefore wedge-shaped projections 66 being arranged on the base plate 2 in the zone (area) below the free ends of the spring fork 31''. In contrast to the foregoing embodiment the spring fork 31'' does not have on its free end control cams, however, it is flat in this zone.

This heel holder 601 operates as follows: An automatic release of the front jaw (not illustrated) occurs when the skiboot is lifted from the upper side of the ski, the stepping plate 6 is released and the ski brake is swung by its erecting spring (not illustrated) from the retacted position in which it is parallel to the upper side of the ski to the braking position in which it is inclined to the upper side of the ski and the two braking mandrels 7 project downwardly. At the same time, the two control rods 64' are moved together with their control cams 65' along the inclined surfaces of the two wedge-shaped projections 66, which are arranged on the base plate 2, upwardly. Because of this movement, the free ends of the spring fork 31'' move by the control cams 65' so that the locking member 54 is moved out of the detent on the rear side of the swivel part 51 and the heel holder 601 releases.

Figure 12:
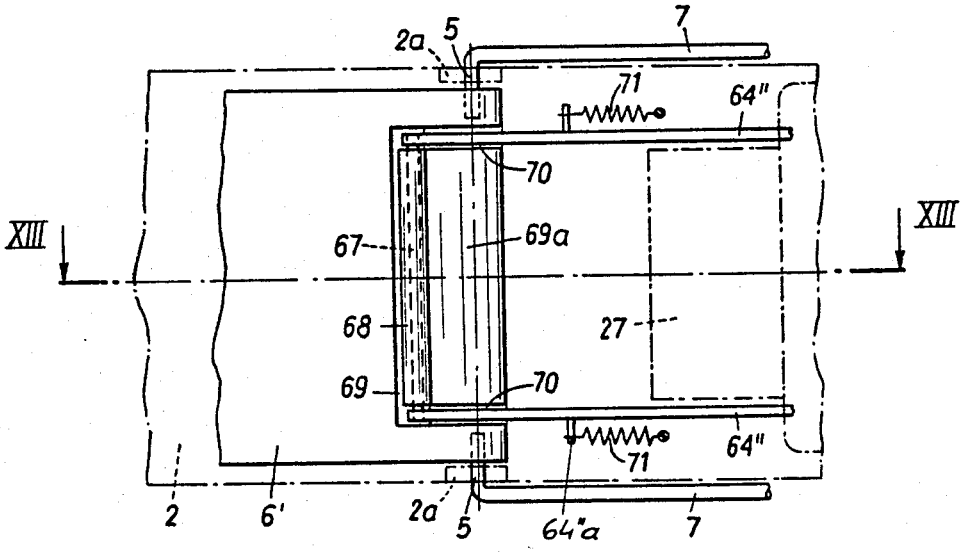
FIGS. 12 to 14 show a further embodiment, FIG. 12 a top view of the stepping plate, FIG. 13 being a sectional view taken along the line XIII—XIII of FIG. 12 and FIG. 13 being a sectional view similar to FIG. 12 but showing the ski brake in the braking position.
Figure 13:
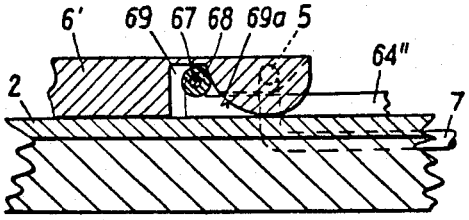
Figure 14:
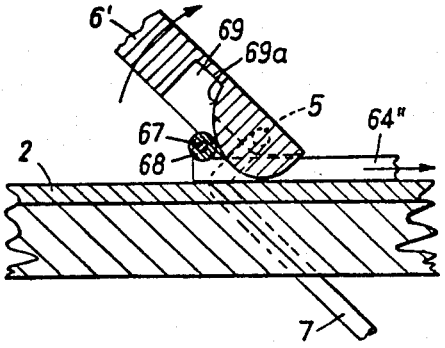

The heel holder illustrated in FIGS. 12 to 14, of which a detail is illustrated only, involves the form of the spring fork 31 and involves the control cams 65 which are arranged on the control rods 64'' similar to the heel holder 501 which is illustrated in FIGS. 7 to 10. A difference is that the two control rods 64'' are guided slidably along their total length on the base plate 2. Furthermore the two control rods 64'' are connected by an axle 67 which is arranged on the ends of the control rods 64'' which are far from the control cams. On the axle 67 there is arranged a roller 68. The stepping plate 6' has in its middle zone near to the axis 5 an opening 69 arranged in a cross direction and lying with its opening downwardly. The opening 69 is defined versus the axis 5 by a spiral cam surface **69*a*. The roller 68 lies on this surface 69*a*. In the stepping plate 6' there are slots 70 which enable this plate to swing with respect to the control rods 64''. The two control rods 64'' are biased by spiral tension springs 71 which are each fixed to one projection 64''*a* of the two control rods 64'' and to the base plate 2 respectively. The two control rods 64'' are biased by these springs 71 toward the heel holder and hold the roller 68 continously to the curve shaped surface 69**.

This heel holder operates as follows: During an automatic release of the front jaw (not illustrated) the ski boot lifts away from the upper side of the ski, the stepping plate 6' is released and the ski brake is swung by its erecting spring (not illustrated) from the retracted position in which it is parallel to the upper side of the ski (see FIG. 13) to the braking position in which it is inclined to the upper side of the ski and the two braking mandrels 7 project downwardly (see FIG. 14). The swinging movement of the step plate 6' occurs through the curve shaped surface **69*a*, the roller 68 and the axle 67 and axial movement of the two control rods 64''. This movement effects a release of the heel holder as it is written in connection with the embodiment according to the FIGS. 7 to 10**.

Of course, various modifications of the illustrated heel holder which is combined with a ski brake are possible without leaving the scope of the invention. For example, an embodiment in which rollers are provided at the ends of the control rods 64 next to the cams 65, which rollers roll along on the base plate 2, falls under the scope of protection of the invention.

Furthermore, the ski brake may have any desired type of construction, assuming that the structural parts which on the one hand are needed for the control of the heel holder and on the other hand for effective braking are provided. For example, it advantageously is possible to use a ski brake with braking mandrels which, in the retracted position, are pulled or swung inwardly of the two ski edges.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A heel holder for a ski binding which is adapted to releasably hold a ski boot on a ski, comprising a ski brake, a bearing block supported on a base plate which can be secured on the ski, and a housing which is supported on said bearing block for pivotal movement about a transverse axis, said housing having sole down-holding means thereon, being biased by a torsion spring, and being releasably held in a skiing position approximately parallel to an upper side of the ski by means which includes at least one locking lever which is biased by a locking spring, said ski brake having braking mandrels which are supported for pivotal movement about a transverse pivot axis on said base plate, having a stepping plate, and being operationally connected by a coupling member to said locking lever; wherein said coupling member is a linking rod which is pivotally supported at one end on said ski brake and is pivotally supported at its other end on an end of said locking lever; wherein said linking rod is pivotally supported on a half of said stepping plate which is adjacent said pivot axis of said braking mandrels of said ski brake.

2. A heel holder for a ski binding which is adapted to releasably hold a ski boot on a ski, comprising a ski brake, a bearing block supported on a base plate which can be secured on the ski, and a housing which is supported on said bearing block for pivotal movement about a transverse axis, said housing having sole downholding means thereon, being biased by a torsion spring, and being releasably held in a skiing position approximately parallel to an upper side of the ski by means which includes at least one locking lever which is biased by a locking spring, said ski brake having braking mandrels which are supported for pivotal movement about a transverse axis on said base plate, having a stepping plate, and being operationally connected by a coupling member to said locking lever; wherein said coupling member is a rod which has one end pivotally supported on said ski brake and has its other end resting against said locking lever.

3. The heel holder according to claim 2, wherein a pair of said rods is provided, each said rod having said one end thereof pivotally supported in a bearing eye provided on an end of said stepping plate which is adjacent said pivot axis of said braking mandrels of said ski brake.

4. The heel holder according to claim 2, wherein said other end of each said rod is guided in a guideway provided in one of said base plate and said bearing block.

5. A heel holder for a ski binding which is adapted to releasably hold a ski boot on a ski, comprising a ski brake, a bearing block supported on a base plate which can be secured on the ski, and a housing which is supported on said bearing block for pivotal movement about a transverse axis, said housing having sole downholding means thereon, being biased by a torsion spring, and being releasably held in a skiing position approximately parallel to an upper side of the ski by means which includes at least one locking lever which is biased by a locking spring, said ski brake having braking mandrels which are supported for pivotal movement about a transverse axis on said base plate, having a stepping plate, and being operationally connected by a coupling member to said locking lever; wherein said coupling member is a draw element which has one end pivotally supported on said stepping plate of said ski brake and has its other end supported on said locking lever.

6. The heel holder according to claim 5, wherein said locking lever is a two-arm lever having a pawl tooth on one arm thereof, said locking spring being a compression spring and cooperating with said arm of said locking lever which carries said pawl tooth, the other arm of said locking lever being engaged by said draw element.

7. The heel holder according to claim 5, wherein said locking lever is a two-arm lever having a pawl tooth on one arm thereof, the other arm of said lever being engaged by said draw element and being connected to said locking spring, said locking spring being a contraction spring.

8. A heel holder for a ski binding which is adapted to releasably hold a ski boot on a ski, comprising a ski brake, a bearing block supported on a base plate which can be secured on the ski, and a housing which is supported on said bearing block for pivotal movement about a transverse axis, said housing having sole downholding means thereon, being biased by a torsion spring, and being releasably held in a skiing position approximately parallel to an upper side of the ski by means which includes at least one locking lever which is biased by a locking spring, said ski brake having braking mandrels which are supported for pivotal movement about a transverse axis on said base plate, having a stepping plate, and being operationally connected by a coupling member to said locking lever; wherein said locking lever is a locking part which is pivotally supported on said housing, a rear side of said locking part being engaged by a locking member which is biased by said locking spring and is movably supported on a movably supported spring fork, and wherein said coupling member is operationally cooperable with ends of said spring fork so as to effect movement thereof.

9. The heel holder according to claim 8, wherein said coupling member is formed by two control rods which extend longitudinally of the ski.

10. The heel holder according to claim 9, wherein a free end of each of said control rods has an upwardly directed control cam, said control cams being cooperable with control cams which are provided on free ends of said spring fork and project downwardly.

11. The heel holder according to claim 1, wherein a free end of each of said control rods is slidably guided on an upper side of said base plate.

12. The heel holder according to claim 9, wherein said control rods are guided in vertically extending slots provided in said housing and in a front part of said bearing block so as to prevent transverse horizontal movement of said control rods.

13. The heel holder according to claim 10, wherein two projections are provided on said base plate in a region below the free ends of said spring fork and serve to lift the free ends of said control rods during movement thereof.

14. The heel holder according to claim 9, wherein said base plate has along a path of movement of the free ends of said control rods a coating of a low friction material.

15. The heel holder according to claim 10, wherein said control rods and said spring fork are hardened in the region of said cams thereon.

16. The heel holder according to claim 8, wherein said stepping plate and said braking mandrels are pivotally supported on a swivel axle which is coaxial with said pivot axis, and wherein said control rods are slidably guided over their entire length on said base plate and are moved by cams provided on said swivel axle.

17. A sole holding apparatus for a ski binding which is adapted to releasably hold a ski boot on a ski, comprising: a base adapted to be mounted on the ski; a sole holder which can engage a sole of the ski boot; means supporting said sole holder on said base for movement between a skiing position and a release position; first resilient means yieldably urging said sole holder toward said release position thereof; locking means for resisting movement of said sole holder away from said skiing position toward said release position with a force greater than the force exerted by said first resilient means; a ski brake supported for movement between a braking position and a retracted position and having a stepping plate and a braking mandrel, said braking mandrel projecting downwardly below an undersurface of the ski in said braking position and being disposed above the undersurface of the ski in said retracted position, wherein said stepping plate is engaged by a ski boot being inserted into said binding and effects movement of said ski brake from said braking position to said retracted position; second resilient means cooperable with said ski brake for yieldably urging said ski brake toward said braking position; and coupling means operatively coupling said ski brake and said locking means for temporarily disabling said locking means in response to movement of said ski brake from said retracted position to said braking position when said sole holder is in said skiing position, said sole holer thereafter being moved to said release position by said first resilient means free of resistance by said locking means.

18. The sole holding apparatus according to claim 17, wherein said locking means includes selectively actuable release means for temporarily disabling said locking means in order to permit said sole holder to move from said skiing position to said release position free from resistance by said locking means, said coupling means being cooperable with said release means and causing said release means to temporarily disable said locking means in response to movement of said ski brake.

19. The sole holding apparatus according to claim 18, wherein said release means includes a member supported for approximately vertical movement relative to said base, said locking means resisting upward movement of said sole holder relative to said member; wherein said release means includes a locking lever which is pivotally supported on said base and is movable between a first position in which a notch thereon engages said member and a second position in which said notch is spaced from said member; and wherein said coupling means effects pivotal movement of said locking lever from said first position to said second position in response to movement of said ski brake from said retracted position to said braking position under the urging of said second resilient means.

20. The sole holding apparatus according to claim 19, wherein said release means includes third resilient means yieldably urging said locking lever toward said first position; wherein said stepping plate and said braking mandrel of said ski brake are supported for pivotal movement about a transversely extending pivot axis; and wherein said coupling means includes an elongate control rod having one end pivotally supported on said stepping plate at a location spaced radially from said pivot axis and having a slot in its other end, said locking lever having a pin thereon which is slidably received in said slot.

21. The sole holding apparatus according to claim 19, wherein said release means includes third resilient means yieldably urging said locking lever toward said first position; wherein said stepping plate and said braking mandrel of said ski brake are supported for pivotal movement about a transversely extending first pivot axis; and wherein said coupling means includes an operating lever which is supported on said sole holder for pivotal movement about a transversely extending second pivot axis, said operating lever having a first arm which has an elongate slot therein at a location spaced from said second pivot axis, said stepping plate having a pin thereon at a location spaced from said first pivot axis which is slidably received in said slot in said operating lever, and said operating lever also having a second arm which can slidably engage a cam surface provided on said locking lever to effect pivotal movement of said locking lever from said first to said second position in response to pivotal movement of said operating lever.

22. The sole holding apparatus according to claim 20 or claim 29, wherein said base includes a bearing block having a transversely extending axle thereon; wherein said means supporting said sole holder includes a housing which is pivotally supported on said axle and has said sole holder thereon; wherein said release means includes means defining an arcuate slot in said bearing block approximately concentric to said first axle and a transversely extending pin which is slidably supported in said slot in said bearing block and is said member; and wherein said release means includes a release lever which is movably supported on said housing and a linking member which is operatively coupled to said release lever and said locking lever, manual movement of said release lever causing said linking member to move said locking lever from its first position to its second position.

23. The sole holding apparatus according to claim 19, wherein said release means includes third resilient means yieldably urging said locking lever toward said first position; wherein said stepping plate and said braking mandrel of said ski brake are supported for pivotal movement about a transversely extending pivot axis; and wherein said coupling means includes an elongate control rod having one end pivotally supported on said ski brake at a location spaced from said pivot axis and having its other end extending through a guide opening provided in said base and being engageable with said locking lever, wherein when said ski brake moves from said retracted position to said braking position, said other end of said control rod engages said locking lever and causes it to move from said first to said second position against the urging of said third resilient means.

24. The sole holding apparatus according to claim 23, wherein said base has a transversely extending axle thereon; wherein said sole holder has a cam surface thereon which faces away from a ski boot held by said sole holder; wherein said means supporting said sole holder includes a housing which is pivotally supported on said transverse axle on said base and has said sole holder thereon; wherein said release means includes a support element which is pivotally supported on said transverse axle, said support element having a portion spaced from said transverse axle which is said approximately vertically movable member and is engageable with said notch in said locking lever; wherein said locking means includes a support plate which is supported on said support element at a location spaced from said transverse axle for pivotal movement about a transversely extending axis and which has a transversely extending pin thereon at a location spaced radially from its pivot axis, pivotal movement of said support plate causing said pin to move toward and away from said cam surface on said sole holder; and wherein said locking means includes fourth resilient means which yieldably urges said pin toward said cam surface.

25. The sole holding apparatus according to claim 23, wherein said release means includes a manually operable release lever which is pivotally supported on said base and has a cam thereon which is engageable with said locking lever, pivotal movement of said release lever causing said cam thereon to engage said locking lever and move said locking lever from its first position to its second position.

26. The sole holding apparatus according to claim 19, wherein said release means includes third resilient means which yieldably urges said locking lever toward said second position; wherein said stepping plate and said braking mandrel of said ski brake are supported for pivotal movement about a transversely extending pivot axis; and wherein said coupling means includes an elongate draw rod having one end pivotally supported on said stepping plate at a location spaced from said pivot axis thereof and having its other end operatively coupled to said locking lever, movement of said ski brake from said braking position to said retracted position causing said draw rod to move said locking lever from said second position to said first position against the urging of said third resilient means.

27. The sole holding apparatus according to claim 26, wherein said base has a transversely extending axle thereon; wherein said sole holder has a cam surface which faces away from a ski boot engaged by said sole holder; wherein said means supporting said sole holder includes a housing which is pivotally supported on said transverse axle and has said sole holder thereon; wherein said release means includes a support element which is pivotally supported on said transverse axle and has a slide element supported thereon for approximately radial movement, said slide element being said member which is engageable with and being movable toward and away from said locking lever; wherein said locking means includes a support plate supported on said support element at a location spaced from said transverse axle for pivotal movement about a pivot axis and having a transversely extending pin thereon at a location spaced from its pivot axis, pivotal movement of said support plate causing said pin to move toward and away from said cam surface on said sole holder; and wherein said release means includes a manually operable release lever which is pivotally supported on said support element and is operatively coupled to said slide element, pivotal movement of said release lever relative to said support element effecting movement of said slide element toward and away from said locking lever.

28. The sole holding apparatus according to claim 18, wherein said ski brake is supported for movement between said braking and retracted positions about a pivot axis; wherein said base has a locking projection thereon; wherein said sole holder moves approximately vertically between said skiing and release positions; wherein said locking means includes a locking part which is pivotally supported on said sole holder, extends generally downwardly from its pivot axis, has a portion which is engageable with said locking projection on said base and has a detent in a side thereof opposite said portion which can engage said locking lever; wherein said locking means includes a support element which is supported for approximately vertical movement, a locking member supported on said support element for approximately horizontal movement toward and away from said side of said locking part having said detent, and third resilient means which yieldably urges said locking member toward said locking part, said locking member slidably engaging said locking part; and wherein said coupling means includes an elongate control rod having one end pivotally supported on said stepping plate of said ski brake at a location spaced from said pivot axis thereof and its other end slidably supported on a surface of said base, and includes means defining a cam on one of said support element and said base, wherein when said ski brake moves from said retracted position to said braking position said other end of said control rod slides along said surface on said base and cooperates with said cam to effect upward movement of said support element and locking member relative to said locking part.

29. The sole holding apparatus according to claim 18, wherein said stepping plate and said braking mandrel of said ski brake are supported for pivotal movement about a transversely extending axis, wherein said stepping plate has thereon a spiral cam surface; wherein said coupling means includes an elongate control rod which is supported for movement approximately longitudinally of the ski and has a roller at one end thereof which engages said spiral cam surface on said stepping plate; wherein said coupling means includes resilient means cooperable with said control rod for yieldably urging lengthwise movement of said control rod in a direction causing said roller thereon to move into engagement with said spiral cam surface; and wherein said coupling means includes means operatively coupling said control rod to said release means for causing said release means to selectively disable said locking means in response to movement of said control rod.

* * * * *

UNITED STATES PATENT AND TRADEMARK OFFICE

CERTIFICATE OF CORRECTION

PATENT NO. : 4 496 167

DATED : January 29, 1985

INVENTOR(S) : Erwin KROB

It is certified that error appears in the above-identified patent and that said Letters Patent is hereby corrected as shown below:

Column 12, line 28; change "Claim 1" to ---Claim 9---.

Column 14, line 5; change "Claim 29" to ---Claim 21---.

Signed and Sealed this

First Day of October 1985

[SEAL]

*Attest:*

DONALD J. QUIGG

*Attesting Officer*

*Commissioner of Patents and Trademarks—Designate*